US005706835A

United States Patent [19]

Salvino

[11] Patent Number: 5,706,835

[45] Date of Patent: Jan. 13, 1998

[54] DEVICE FOR MANICURING FINGERNAILS AND METHOD OF USE

[76] Inventor: Larry P. Salvino, 1815 Elm Ct., Dundee, Ill. 60118

[21] Appl. No.: 566,890

[22] Filed: Dec. 4, 1995

[51] Int. Cl.[6] ..... A45D 29/04

[52] U.S. Cl. ..... 132/75.6; 132/73; 132/76.4; 451/495.1

[58] Field of Search ..... 132/73, 73.5, 75.6, 132/76.4, 75.3, 76.5; 451/495, 507, 514; 51/295

[56] References Cited

U.S. PATENT DOCUMENTS

| | | | |
|---|---|---|---|
| D. 46,636 | 11/1914 | Girndt . | |
| D. 115,408 | 6/1939 | Johnson . | |
| D. 133,008 | 7/1942 | McCall . | |
| D. 159,662 | 8/1950 | Patek . | |
| 893,004 | 7/1908 | Miller . | |
| 894,161 | 7/1908 | Miller . | |
| 900,758 | 10/1908 | Miller | 132/76.4 |
| 959,213 | 5/1910 | Ganz . | |
| 1,014,629 | 1/1912 | Mendelshon | 132/75.6 |
| 1,163,455 | 12/1915 | Randolph . | |
| 1,165,452 | 12/1915 | Rudolph | 451/495 |
| 1,312,653 | 8/1919 | Watrous . | |
| 1,492,470 | 4/1924 | Kirby | 132/75.6 |
| 1,588,160 | 6/1926 | Booty . | |
| 1,894,142 | 1/1933 | Wurzburger | 132/75.6 |
| 1,920,738 | 8/1933 | Bently . | |
| 2,132,889 | 10/1938 | Ayres | 132/76.5 |
| 2,177,205 | 10/1939 | Dalmas | 132/73.5 |
| 2,215,877 | 9/1940 | Johnson . | |
| 2,225,567 | 12/1940 | Neuschaefer . | |
| 2,233,438 | 3/1941 | Troya . | |
| 2,709,443 | 5/1955 | Brite . | |
| 3,298,381 | 1/1967 | Adams | 132/76.4 |
| 3,722,104 | 3/1973 | Enzetti . | |
| 4,184,499 | 1/1980 | Seidler . | |
| 4,206,574 | 6/1980 | Dotsko | 451/495 |
| 4,646,953 | 3/1987 | Marshall et al. . | |
| 4,785,835 | 11/1988 | Bray . | |
| 5,287,863 | 2/1994 | La Joie et al. . | |

FOREIGN PATENT DOCUMENTS

| | | |
|---|---|---|
| 348120 | 5/1937 | Italy . |
| 876141 | 8/1956 | United Kingdom . |

OTHER PUBLICATIONS

Hong Kong Enterprise Feb. 1993, p. 427; Emery Baord as indicated by arrow.

Hong Kong Enterprise Oct. 1989, p. 517; Nail file indicated by arrow.

*Primary Examiner*—Gene Mancene
*Assistant Examiner*—Philogene Pedro
*Attorney, Agent, or Firm*—Banner & Witcoff, Ltd.

[57] ABSTRACT

A device including pivotally attached first and second panels each having a top, mid-section and foot and a flexible abrasive strip connecting the feet of the first and second handles with a grip in the mid-section of the first and second handles.

24 Claims, 3 Drawing Sheets

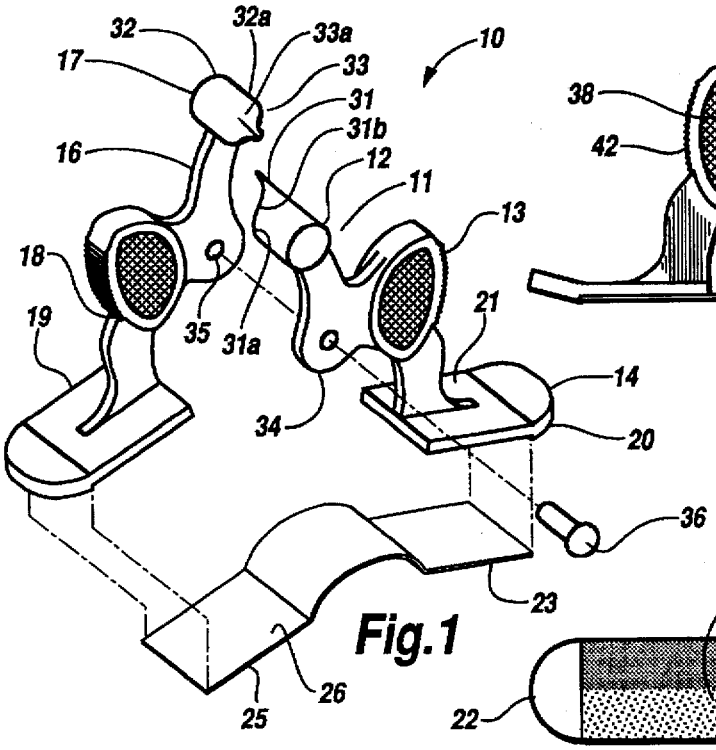
Fig.1
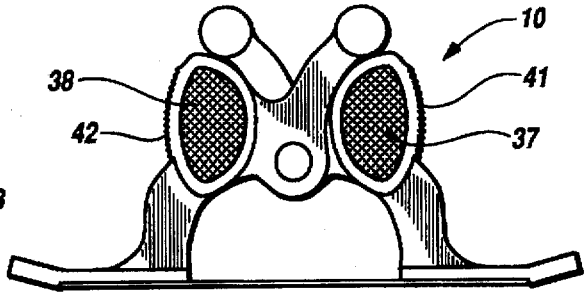
Fig.2
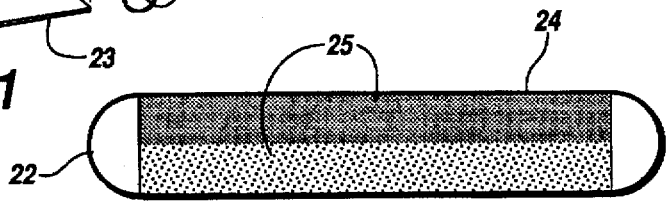
Fig.3
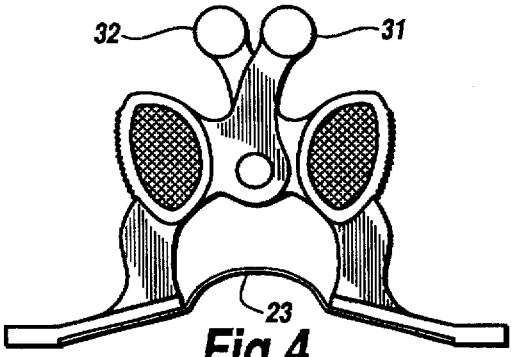
Fig.4
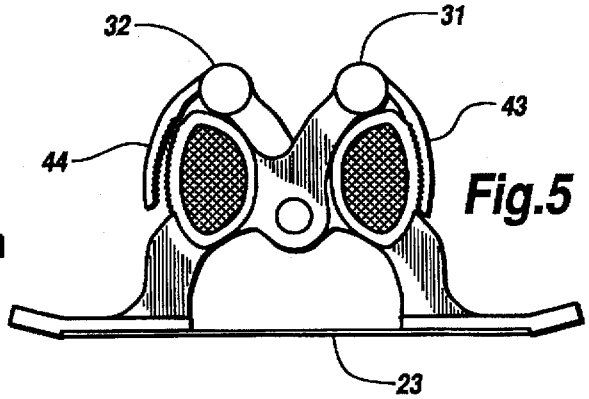
Fig.5
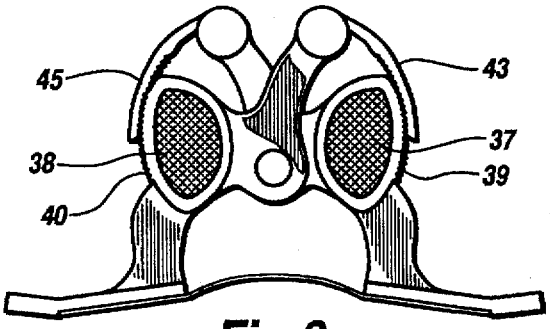
Fig.6
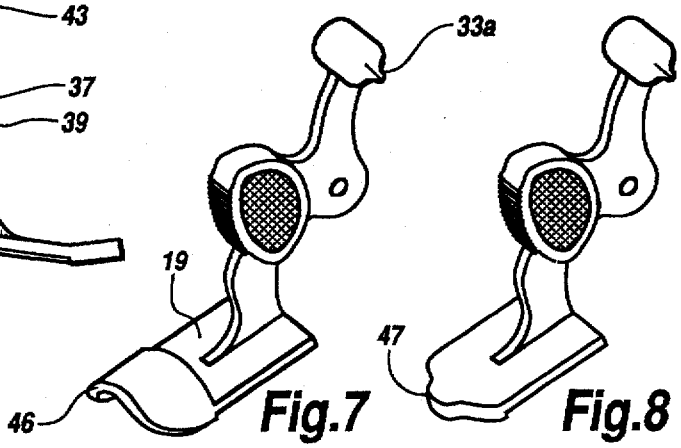
Fig.7
Fig.8

DEVICE FOR MANICURING FINGERNAILS AND METHOD OF USE

BACKGROUND OF THE INVENTION

1. Field of the Invention

This invention relates to an all purpose implement for manicuring fingernails. More particularly, it relates to improvements in manicure implements having an easy to grip handle, flexible grit, nail cleaner and cuticle pushers. Additionally, this invention relates to a method of styling nails.

2. Background of the Invention

The cleaning, trimming and dressing of nails is an everyday occurrence. Conventional devices for performing the forgoing functions by abrasive and other mechanical means are often unsatisfactory. The satisfactory manicure implement that allows you to clean, dress and shape the nails has not been achieved.

Conventional manicure implements comprise many forms. U.S. Pat. No. 3,298,381 describes an elongated implement having a concave topside and a convex underside, with one side having granular abrasive particles for filing nails. U.S. Pat. No. 2,233,438 describes a ridged nail file having an undulating pattern so a finger nail may fit within a rounded portion of the ridged nail file for sanding and filing the tip of the nail. U.S. Pat. No. 2,225,567 describes a continuous annular band of flexible fibrous sheet material having the inside coated with an abrasive material so that a finger may be inserted into a loop and the top of the nail sanded to remove ridges. U.S. Pat. No. 2,132,889 describes a buffer for finger nails compressing a flexible holder for a flexible strip of fabric or animal skin to serve as a buffing material for the surface of the nail. U.S. Pat. No. 1,920,738 describes a single piece holder of a flexible material and a band comprising a facing of chamois leather and a backing of fabric and means for attaching a band to the holder. U.S. Pat. No. 1,588,160 describes a nail polishing implement with the holder being hinged at the center and the ends attached to a strip of polishing material. The holder includes two gripping portions. As can be seen from the prior art, there is a need for a manicure implement that serves as a nail styler, cuticle pusher, and trimming device, all in the same implement.

SUMMARY OF THE INVENTION

The present invention relates to a device for manicuring nails comprising a first and a second handle having a top, mid-section and foot, means for pivotally attaching the first and second handles and a flexible abrasive strip connecting the feet of the first and second handles.

Additionally, the invention relates to a method for smoothly abrading and styling nails and removing ridges from the surfaces of the nails.

Further, the present invention relates to a one piece device having a first and second legs with feet, the feet connected by an abrasive strip.

BRIEF DESCRIPTION OF THE DRAWINGS

FIG. 1 is a exploded perspective view of one embodiment of the device of the present invention;

FIG. 2 is a side view of the assembled device of FIG. 1;

FIG. 3 is a bottom view of the abrasive pad attached to the device of FIGS. 1 and 2;

FIG. 4 is the device of the present invention wherein the center of the flexible abrasive strip is moved upwardly as if a finger nail was inserted into the fold of the pad for sanding or filing;

FIG. 5 is a side elevational view of one embodiment of the present invention containing arms that lock the handles of the present invention in place;

FIG. 6 is a side elevational view of the arms engaging the sides of a grip of an embodiment of the present invention;

FIG. 7 shows a modified embodiment of the present invention wherein the handle and foot are shown;

FIG. 8 shows another embodiment in the present invention wherein the handle and foot are shown;

DETAILED DESCRIPTION OF THE INVENTION

Figure 9:
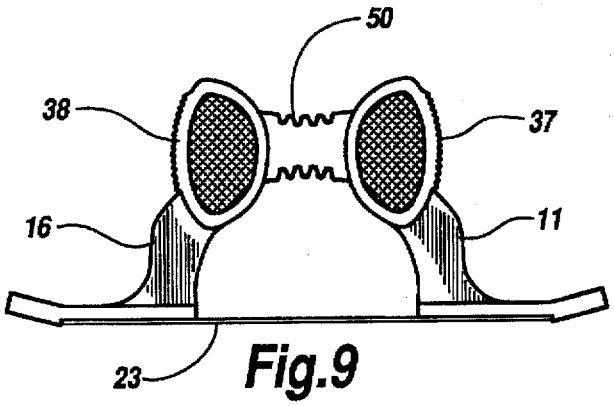
FIG. 9 is a side view of another embodiment of the present invention showing flexible means for joining the handles.

In accordance with an illustrative embodiment of the invention, a first handle having a top, mid-section and a foot and a second handle having a top, mid-section and a foot are provided. The handles may be constructed of any suitable material, such as plastic, rubber, metal, wood, ivory or the like.

Referring to the drawings, particularly FIGS. 1–3, 10 designates the device of the present invention with first handle 11, having a top 12, mid-section 13, and foot 14. The second handle 16 comprises a top 17, a mid-section 18, and foot 19. Both the foot 14 and foot 19 have rounded end portion 20 having top 21 and bottom 22.

A flexible pad or strip 23 having a bottom side 24 with an abrasive coating 25 and a top side 26 contains an adhesive to attach to bottoms 22 of feet 19 and 20, respectively. The coating may be of one composition or more than one composition to provide different abrasive surfaces. Alternatively, the coating may have smooth surface for cleaning, buffing or polishing the top of the nail. Top 12 and 17 of each handle contain head 31 and 32 respectively. Each head contains a first end **31*a* and 32*a* with a concave surface 31*b* for receiving the end of a finger or toe and a point 33 for cleaning nails and a second end. Point 33 may contain a slot 33*a* for receiving the nail for cleaning. Located in each handle is elbow 34 which contains aperture 35 for receiving means for pivotally moving the handles. With no intention of being limiting, the receiving means may be a rivet as shown at number 36. Also located in the mid-section 13 and 18 of handles 11 and 16 are grips 37 and 38, respectively. The grips allow the user to hold the device and manipulate it for shaping and styling nails. Grips 37 and 38 have an outside edge 39 and 40. The outside edge may be serrated or contain ridges 41 and 42** to facilitate holding and manipulating the device.

As shown in FIG. 4, heads 31 and 32 can be pushed together by hand to facilitate moving of the legs and the loosening of flexible strip 23. When loosened, the finger and finger nail (not shown) may be inserted so the perimeter of the nail is in contact with the flexible strip 23, and more particularly with abrasive coating or grit 25.

Another embodiment is shown in FIGS. 5 and 6 wherein arms 43 and 44 are attached to heads 31 and 32, respectively. The arms have an inside edge 45 which is ridged, or serrated, to engage the outside edges 39 and 40 of the respective grips, 37 and 38. As shown in FIG. 6, the arms 43 and 44 may lock the position of the handles to allow engagement of the flexible strip 23 with a nail or finger.

FIG. 7 displays another embodiment of the present invention. The rounded end portion of foot 19 has a concave lower surface 46 to engage a nail of a finger or toe. As shown in FIG. 8, a pointed end portion 47 of foot 19 is shown. The pointed end portion, as well as the concave lower surface 46, allow for styling and shaping the nail by pushing the cuticle.

Figure 10:
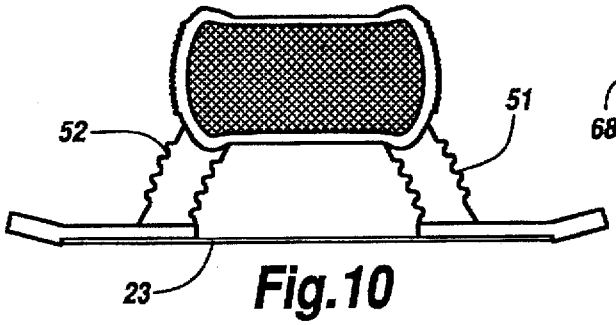
FIG. 10 is another embodiment of the present invention showing flexible handles.

Another embodiment is shown in FIG. 9 wherein the first and second handles are connected by means 50 for flexibly joining the handles. Means 50 may be any flexible material to serve the purpose, such as plastic, so that it may be compressed and released to return to its initial position. The same type of materials may be used in handles 51 and 52 respectively as shown in FIG. 10. The handles being flexible, allow for the compressibility of the handles when a finger is contacted with flexible strip 23. This contact allows for the sanding, shaping and styling of the nail.

Figure 11:
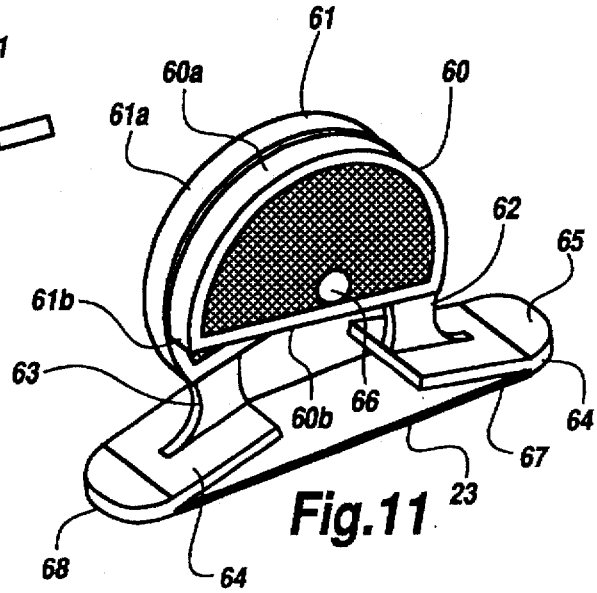
FIG. 11 is another embodiment of the present invention showing large pivotally attached handles.

FIG. 11 shows another embodiment of the present invention wherein semi-circular grips 60 and 61, respectively, are attached to legs 62 and 63. The grips have a first edge 60*a* and 61*a* that is semi-circular and a second edge 60*b* and 61*b* that is straight. The legs are extension of the grips and are attached to feet 64 and 65 respectively. Means for pivoting the handles is shown at 66. The large grips provide facile holding of the device. Flexible strip 23 is attached to the underside 67 of the rounded end portion 68 and 69 of foot 64 and 65 of this embodiment. This attachment allows for the grip 60 and 61 to be rotated and provides space for the insertion of a finger or toe and nail so that the strip 23 may flex and fit around the perimeter of the nail for sanding and styling.

Figure 12:
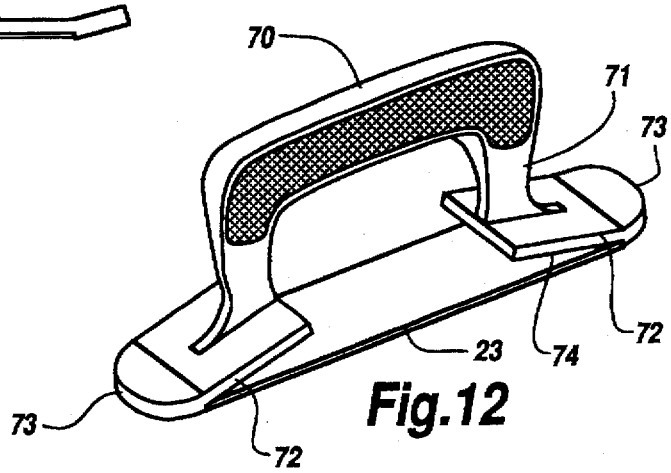
FIG. 12 is another embodiment of the present invention showing a one piece handle having first and second legs containing feet.

A one piece handle 70 is shown in FIG. 12. The one-piece handle is connected to legs 71 and feet 72 with rounded end portions 73.

The flexible strip 23 is adhesively attached to the bottom side 74 of the rounded end portions 73. This arrangement, as also shown in the embodiment of FIG. 11, allows for flexibility of strip 23.

Figure 13:
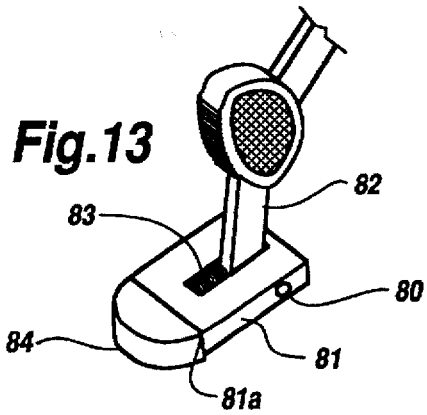
FIG. 13 is another embodiment of the present invention showing a handle and a foot having an adjustable portion for pushing cuticles and moving the flexible strip.

Pivoting means 80 are shown in FIG. 13 to allow movement of foot 81 on leg 82. Spring 83, within foot 81, is attached to rounded end portion 84 which engages and slides on base 81*a* of foot 81 towards leg 82 to provide a cushioning effect and transverse movement when the rounded end portion is utilized in contacting cuticles. The means for adjusting spring 83 allows the application of pressure on the cuticle. The end portion depresses spring 83 and slides transversely on base 81*a* when pressure is applied to the cuticle. The rounded end portion 84 resumes its normal position once the pressure is relieved and the spring is allowed to relax, moving the end portion away from leg 82. The rounded end portion also moves transversely on base 81a when a finger is inserted into the center of flexible strip 23 and and pressure is applied.

Figure 14:
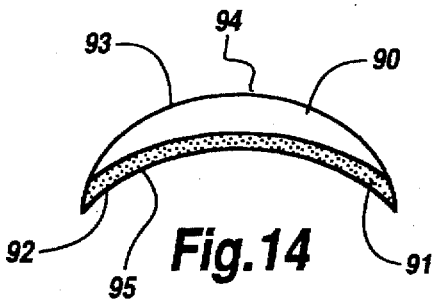
FIG. 14 shows a perspective view of another embodiment of the present invention comprising a one piece fingernail styler, shaper and cleaner.

FIG. 14 shows another embodiment of the present invention wherein one piece handle 90 has a first side 91 with an arcuate edge 92 and a second side 93 with a concave edge 94. Grit or abrasive material 95 is coated on arcuate edge 92 for sanding or styling nails. The device may easily be manipulated by the user to style nails.

Figure 15:
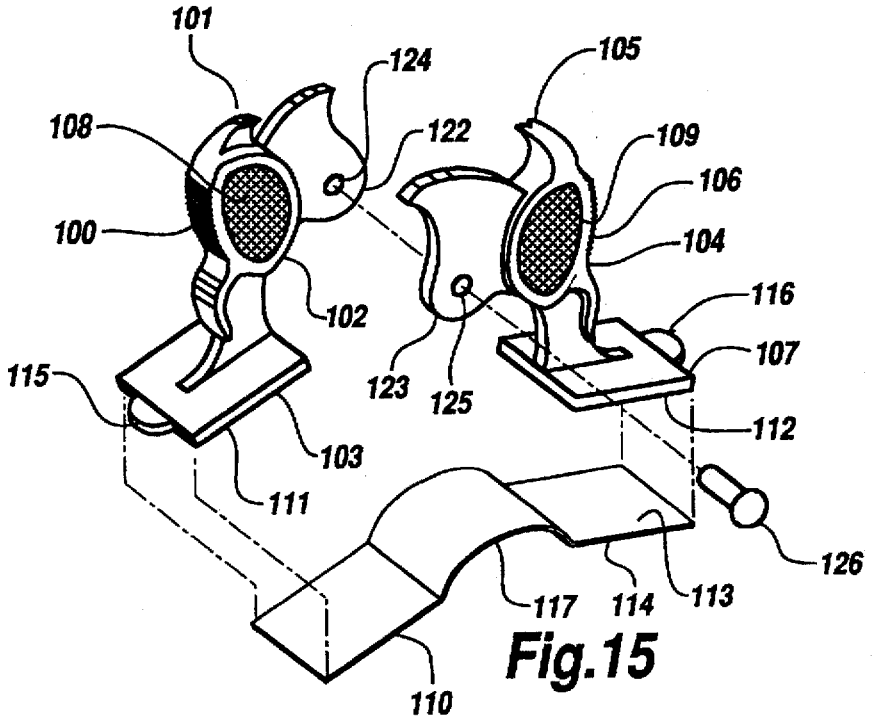
FIG. 15 shows an exploded perspective view of another embodiment of the present invention.
Figure 16:
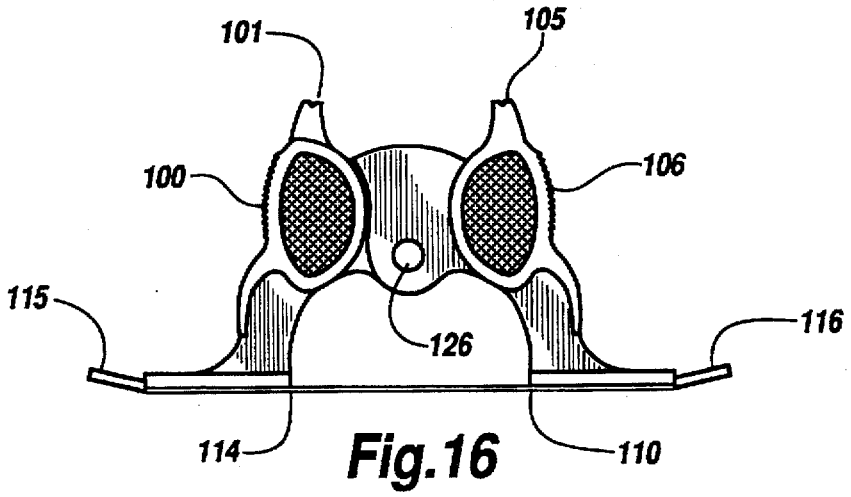
FIG. 16 shows a side view of the device of FIG. 15.

FIGS. 15 and 16 show yet another embodiment of the present invention wherein the first handle 100 comprises a top 101, mid-section 102 and foot 103. The second handle 104 comprises a top 105, mid-section 106 and foot 107.

Tops 101 and 105 are pointed and grooved for facile cleaning of nails. Mid sections 102 and 106 have grips or handles 108 and 109, respectively. The mid-sections are attached to feet 103 and 107 respectively. The feet are square shaped so that flexible strip 110 can be attached to the bottom 111 and 112 thereto. The upper side 113 of flexible strip 110 contains an adhesive for attaching the strip to the bottom of the feet. The lower side 114 of strip 110 contains abrasive surfaces for sanding and shaping nails. Protruding from feet 103 and 107 are cuticle pushers 115 and 116, respectively.

Located in each handle at elbow 122 and 123 in the mid-section is an aperture 124 and 125 for receiving means for pivotally moving the handles. With no intention of being limiting, the pivoting means may be a rivet as shown at number 126. The center of flexible strip 117 loosens when handles 100 and 104 are pushed together when held below the mid-section of the device. When held above the mid-section of the handles, the flexible strip remains rigid. A finger and nail is inserted in the center of the flexible strip so the abrasive surface of the strip contacts the nail for sanding and styling.

The nail perimeter may be treated, trimmed or styled by pressing the nail on the outer surface of the flexible strip between the feet of the device. The other hand may manipulate the handles by pushing the tops together to create slack in the flexible strip. With the nail inserted in the slackened area, the other hand may reciprocatively move the device transversely for frictional engagement with the perimeter of the nail.

For removing longitudinal ridges from the surfaces of the nails or polishing the surface of the nails, the flexible strip with the appropriate surface, smooth for polishing the nail, rough for removing ridges, is attached to the two feet of the device. One hand may hold the flexible strip, particularly the center of the two ends of the strip attached to the feet of the device on the top surface of the nail. Pressure is applied on the top nail surface while reciprocating transversely of the nail the strip on the nail surface.

While my invention has been described in terms of and with the aid of specific embodiments, it will be apparent that numerous variations in detail, material and dimensions and the like are possible within the broad scope of the invention as set forth in the claims which follow.

What is claimed:

1. A device for manicuring fingernails comprising:

(a) a first handle having a top, mid section and foot;

(b) a second handle having a top, mid section and foot;, (c) means for pivotally attaching the first and second handles; and (d) a flexible abrasive strip connecting the feet of the first and the second handles.

2. The device in accordance with claim 1 wherein the top of the first and second handles is a nail cleaner.

3. The device in accordance with claim 2 wherein the top of first and second handles is a nail cleaner comprising a first end and a second end, the first end being adapted to contact the top of a finger and protrude under the fingernail for cleaning.

4. The device in accordance with claim 3 wherein the top of the first and second handles is a nail cleaner having a first end that is concavely shaped to contact a fingertip and nail, the top including a point for cleaning fingernails.

5. The device in accordance with claim 4 wherein the point for cleaning fingernails has a slot for receiving the fingernail for cleaning.

6. The device in accordance with claim 1 wherein the first and second handle contain a grip in the midsection of the respective handles.

7. The device in accordance with claim 1 wherein the first and second handles each have a foot, the foot having a first end and a second end, the first end being rounded to push cuticles.

8. The device in accordance with claim 7 wherein the foot is concavely shaped.

9. The device in accordance with claim 1 wherein the flexible adhesive strip has a first side and a second side, the first side being adhesively attached to the feet and the second side containing a plurality of grit surfaces.

10. The device in accordance with claim 6 wherein the grip has an inside edge and an outside edge, the outside edge containing grooves.

11. The device in accordance with claim 1 wherein the first and second handles have a top with a flexible arm for engaging the outside edge of the grip for locking the device in a set position.

12. The device in accordance with claim 1 wherein the first and second handles have feet, each of which is pivotally attached to the handle.

13. The device in accordance with claim 7 wherein the handle and first end of the foot is flexibly mounted for lateral movement to aid in the pushing of cuticles and the filing, sanding and styling of nails.

14. A device for manicuring fingernails comprising:

(a) a first leg with a grip and a foot;

(b) a second leg with a grip and a foot;

(c) means for flexibly joining the first and second legs; and (d) a flexible adhesive strip connecting the feet of the first and second legs, the flexible adhesive strip having a first side and a second side, the first side being adhesively attached to the feet and the second side containing a plurality of grit surfaces.

15. A device for manicuring fingernails comprising:

(a) a first leg with a foot;

(b) a second leg with a foot;

(c) a handle joining the first and second legs; and (d) a flexible adhesive strip connecting the feet of the first and second legs, the flexible adhesive strip having a first side and a second side, the first side being adhesively attached to the feet and the second side containing a plurality of grit surfaces.

16. The device in accordance with claim 15 wherein the first and second legs may be any flexible material selected from the group consisting of plastic, rubber, wood, metal and ivory.

17. A device for manicuring fingernails comprising:

(a) a first handle having a leg and a foot;

(b) a second handle having a leg and a foot;

(c) the first handle and second handle being pivotally attached; and (d) a flexible abrasive pad connecting the feet of the first and second handle.

18. The device in accordance with claim 17 wherein the first and second handles each have a first edge that is semi-circular and a second edge that is straight to provide a grip.

19. The device in accordance with claim 18 wherein the flexible adhesive pad has a first side and a second side, the first side being adhesively attached to the feet and the second side containing a plurality of grit surfaces.

20. A device for manicuring fingernails comprising:

(a) a one-piece handle having a first leg with a foot and a second leg with a foot; and (b) a flexible adhesive strip connecting the feet of the first leg and the second leg, the flexible adhesive strip having a first side and a second side, the first side being adhesively attached to the feet and the second side containing a plurality of grit surfaces.

21. The device in accordance with claim 20 wherein the handle is elongated for facile griping by a hand.

22. A method of styling nails comprising:

(a) pressing the nail to be styled into a flexible strip with an abrasive surface, the strip being attached between two feet which are each attached respectively to a handle having a mid section and a top, the handles being pivotally attached; and (b) reciprocating transversely of the nail the flexible strip by hand with the abrasive surface to style or trim the nail.

23. The method in accordance with claim 22 wherein the top of the nail is pressed into the abrasive surface of the flexible strip.

24. The method in accordance with claim 20 wherein a buffing surface is on the flexible strip and it is applied to contact the top of the nail so it may be buffed or polished.

* * * * *